US007249426B2

(12) United States Patent
Romano et al.

(10) Patent No.: US 7,249,426 B2
(45) Date of Patent: Jul. 31, 2007

(54) FOOTWEAR STRUCTURE

(76) Inventors: Calvani Romano, Via Civitanova, 162, I 62012 Civitanova Marche (IT); Bacchiega Flavio, Via Solferino, 5, I 31044 Montebelluna (IT)

( * ) Notice: Subject to any disclaimer, the term of this patent is extended or adjusted under 35 U.S.C. 154(b) by 14 days.

(21) Appl. No.: 10/416,266

(22) PCT Filed: Aug. 1, 2002

(86) PCT No.: PCT/EP02/08626

§ 371 (c)(1),
(2), (4) Date: May 9, 2003

(87) PCT Pub. No.: WO03/013301

PCT Pub. Date: Feb. 20, 2003

(65) Prior Publication Data

US 2004/0148804 A1 Aug. 5, 2004

(30) Foreign Application Priority Data

Aug. 3, 2001 (IT) ..... TV2001A0107

(51) Int. Cl.
*A43B 13/14* (2006.01)
*A43B 7/14* (2006.01)

(52) U.S. Cl. ..... 36/93; 36/103; 36/45; 36/4; 12/142 E

(58) Field of Classification Search ..... 36/93, 36/102, 103, 97, 88, 25 R
See application file for complete search history.

(56) References Cited

U.S. PATENT DOCUMENTS 4,497 A * 5/1846 Vetter ..... 36/7.1 R
2,220,439 A * 11/1940 Block ..... 36/164
2,252,315 A * 8/1941 Doree ..... 36/9 R
2,756,518 A * 7/1956 Raney ..... 36/9 R
4,944,099 A * 7/1990 Davis ..... 36/97
5,259,126 A * 11/1993 Rosen ..... 36/93
5,325,614 A 7/1994 Rosen
5,425,186 A * 6/1995 Hoyt ..... 36/97
5,682,685 A * 11/1997 Terlizzi ..... 36/8.3
5,713,143 A * 2/1998 Kendall ..... 36/145
5,813,145 A * 9/1998 Prober ..... 36/93
6,119,373 A * 9/2000 Gebhard et al. ..... 36/114
6,138,385 A 10/2000 Jungkind et al.
6,279,251 B1 8/2001 Davis
6,405,459 B1 * 6/2002 Prevost et al. ..... 36/130
6,836,979 B2 * 1/2005 Flavio et al. ..... 36/103
2002/0078591 A1 * 6/2002 Morrone ..... 36/8.3

FOREIGN PATENT DOCUMENTS

| | | |
|---|---|---|
| DE | 597644 | 5/1934 |
| EP | 1112696 | 7/2001 |
| FR | 887756 | 11/1943 |

* cited by examiner

*Primary Examiner*—Jila M. Mohandesi
(74) *Attorney, Agent, or Firm*—Bryan Cave LLP

(57) ABSTRACT

An improved footwear structure having an upper and a sole, associated to such upper. The footwear structure also having fitting means, which are associated to such upper and such sole for accommodating the internal volume of such footwear structure to the size of a user's foot by means of co-operating resilient deformations of such upper and such sole.

10 Claims, 5 Drawing Sheets

FOOTWEAR STRUCTURE

BACKGROUND OF THE INVENTION

1. Technical Field

The present invention relates to a footwear structure, which is particularly suitable for leisure or sports activities.

2. Background Art

It is notorious that a basic requirement for a footwear structure consists of the fact that it should be counter-shaped as far as possible to the shape of the user's foot in order to obtain a comfortable fit. To achieve this aim, it is usual fabricate articles of footwear in different sizes. Of course, this fact entails the drawback that the higher is the multeplicity of different sizes available for a certain article of footwear, the higher are the production, storage and transportation costs related to such article of footwear and the higher is the difficulty in accomplishing an efficient logistic management of the production and distribution stocks.

Additionally, if the user has an increasing foot size, such as a child, a given footwear article is not likely to fit the user's foot comfortably for very long. In some cases, such footwear article is barely worn before it no longer fits the user's foot. To prevent this, such footwear article can be bought in a larger size. But in this case, the user may slide frontward and backward inside the footwear structure with a reduced comfort.

Other reasons for variation of the foot size may include, for example, weight gain, weight loss, water retention or diseases. In this case, a footwear structure of a certain size could be no more comfortable for the user, who is thus obliged to buy another more comfortable article of footwear.

In order to solve this kind of problems, several adjustable fit footwear articles have been conceived.

In U.S. Pat. No. 6,279,251, it is disclosed a shoe, which includes an expansible liner that comforms to the user's foot of different sizes. The main drawback of this known solution consists of its intrinsic complexity, which very likely entails relatively high production costs. Moreover, while the upper of the shoe is somehow deformable, the size of the sole remains unchanged. This fact could reduce user's comfort, particularly if the shoe is used for sports activities. In fact, if a user with larger foot size wears the shoe, the shoe sole could be no more able to guarantee a suitable support for the user's foot.

In patent application No. TV99U000057, it is disclosed an inner sports shoe for use in ski boots, skates or the like, which comprises two separate elements interconnected by a resiliently deformable intermediate element. The main drawback of this type of sports shoes consists of the fact that they are not in itself suitable for walking. In fact, they generally comprise comprises an upper and a sole, possibly one with each other, fabricated in soft fabrics, since they are basically conceived for being associated to a rigid shell.

Other examples of adjustable fit footwear articles are disclosed in U.S. Pat. No. 5,325,614 and U.S. Pat. No. 6,138,385. In these solutions, adjustable means, which can be operated by the user, are adopted to change the size of the footwear article. Also, these footwear structures have the drawback of being provided with a relatively complex structure, thereby entailing relatively high production costs.

SUMMARY OF THE INVENTION

Therefore, the main aim of the present invention is to provide a footwear structure, which can be worn in maximum comfort also by feet of different shapes and sizes and which is relatively simple in its structure.

Within the scope of the above aim, another important object of the present invention is to provide a footwear structure, which allows achieving a considerable improvement in stock management and remarkable reductions in transportation and storage costs.

Another important object of the present invention is to provide a footwear structure, which can be fabricated with relatively low manufacturing costs.

Thus, the present invention provides, a footwear structure, which comprises an upper and a sole, associated to such upper. The footwear structure, according to the present invention, is characterised in that it comprises fitting means, which are associated to such upper and such sole for accommodating the internal volume of such footwear structure to the size of a user's foot by means of co-operating resilient deformations of such upper and such sole.

BRIEF DESCRIPTION OF THE DRAWINGS

Further characteristics and advantages of the footwear structure, according to the present invention, will become apparent from the detailed description of a particular embodiment, illustrated by way of example in the annexed drawings, but not limited thereto, wherein.

DETAILED DESCRIPTION OF THE INVENTION

Figure 1:
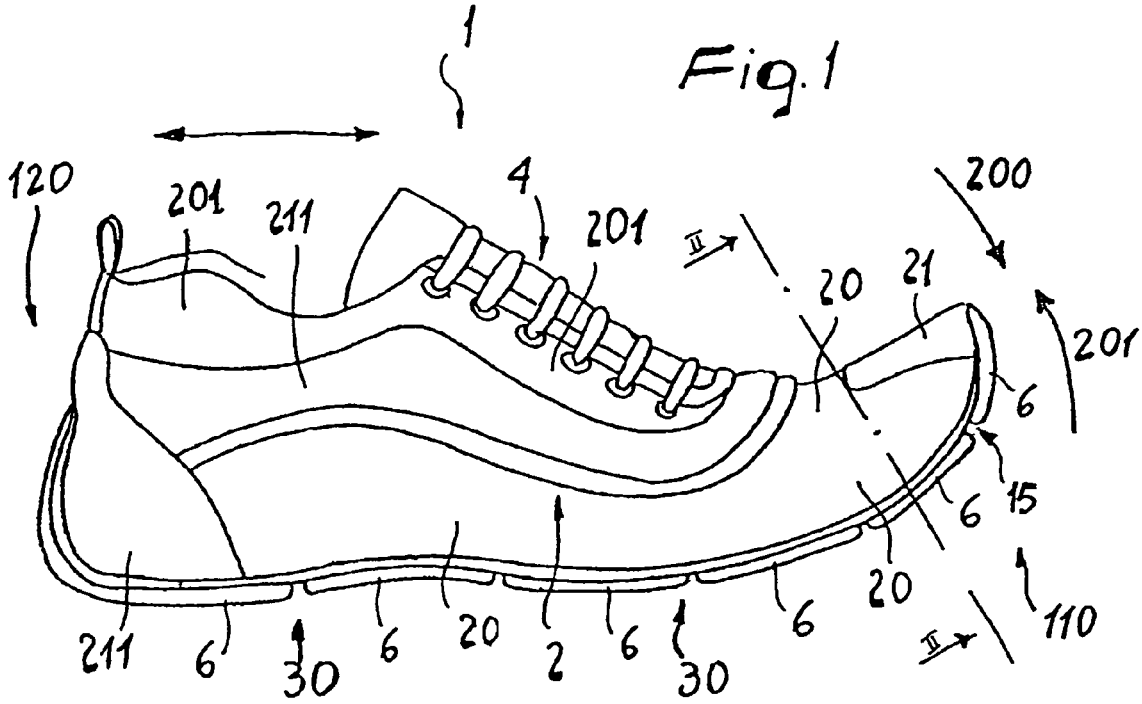
FIGS. 1–2 are different section views of a preferred embodiment of the footwear structure, according to the present invention.
Figure 2:
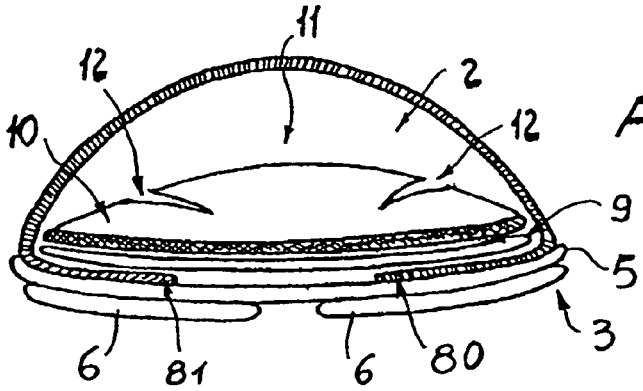

With reference to the above figures, reference number 1 designates a footwear structure, according to the present invention. Such footwear structure 1 comprises an upper 2 associated, at the bottom, to a sole 3. The footwear structure 1, according to the present invention, is provided with self adjustable fitting means, which are associated to the upper and the sole 3, for accommodating the footwear structure 1 to the size of a user's foot. This is obtained by means of inducing co-operating resilient deformations of the upper 3 and the sole 2.

Advantageously, the fitting means comprise one or more first regions 20, 201 that are fabricated in a material, which is resiliently deformable both in a longitudinal and a transverse direction. For this aim, it is possible to use those materials known with the brand name "LYCRA®", or fabrics consisting of a weft fabricated in stretch material (again such as "LYCRA®") combined with yams in polyester or those materials known with the brand name "NYLON®". It is also possible, for example, to use fabrics consisting of a weft fabricated with a composition of several stretch yams, such as "LYCRA®", and other materials, for example the one known and sold under the brand name "CORDURA®". The first regions 20, 201 may be associated to one or more second regions 21, 211, variously shaped, fabricated in materials presenting reduced tension set. The upper 2 may be advantageously provided with known type of fastening devices 4, usually located in the area of the upper surface of the foot or the instep.

Figure 4:
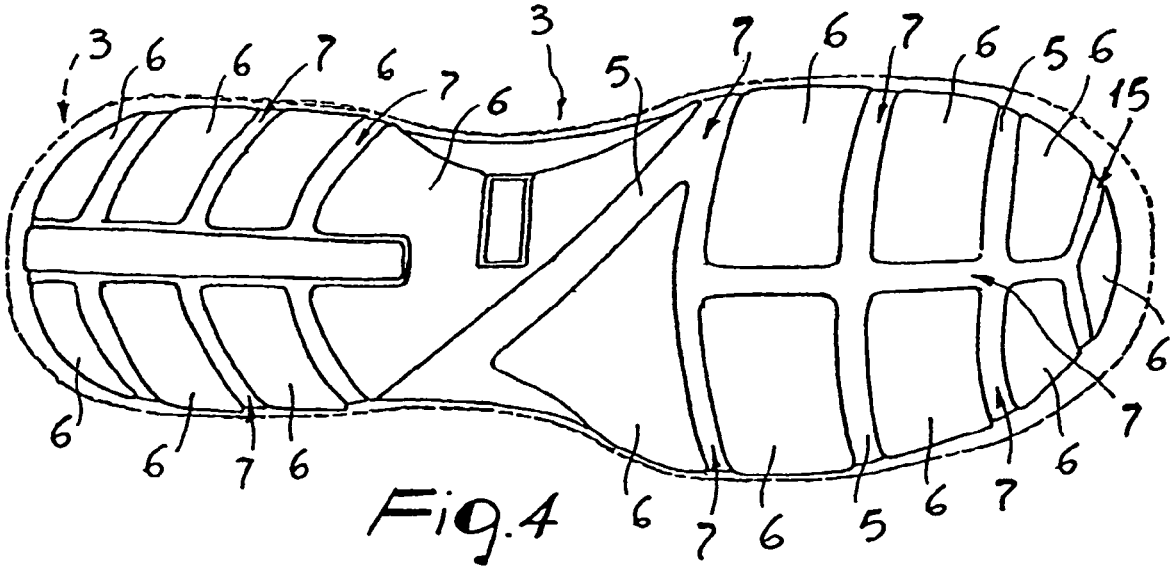
Figure 5:
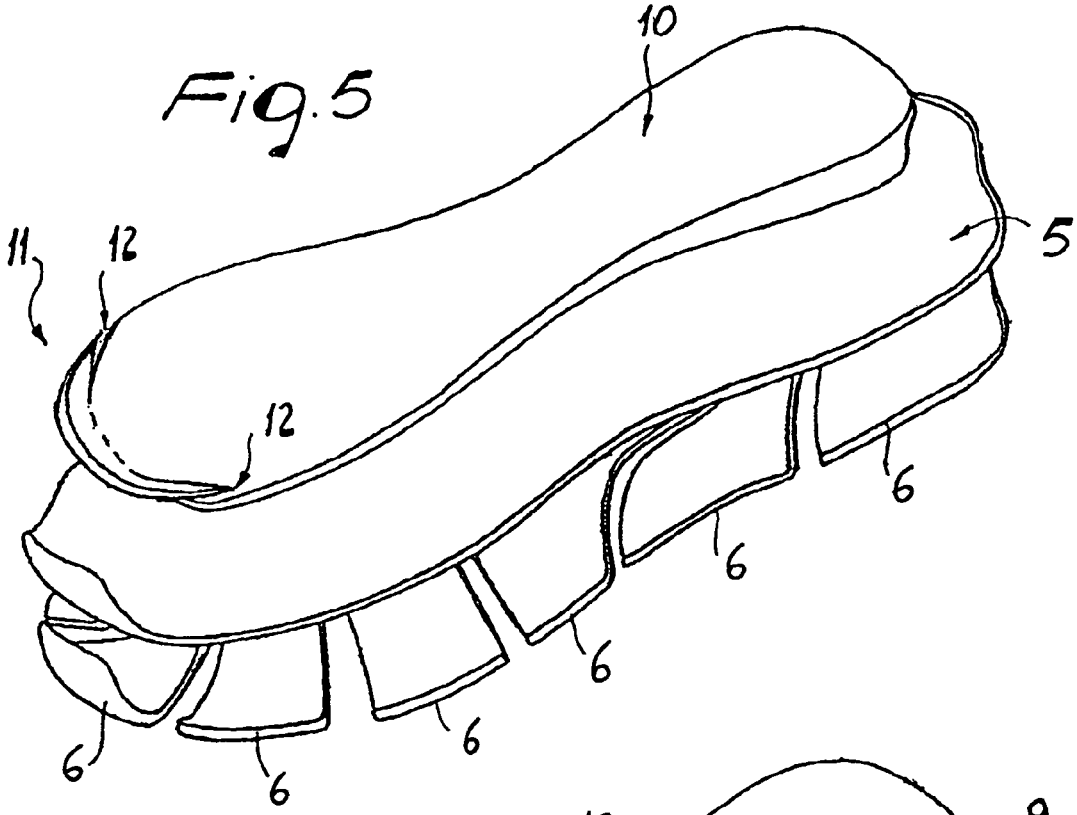
FIGS. 5–6 are exploded views of different embodiments of the sole of the footwear structure, according to the present invention.
Figure 6:
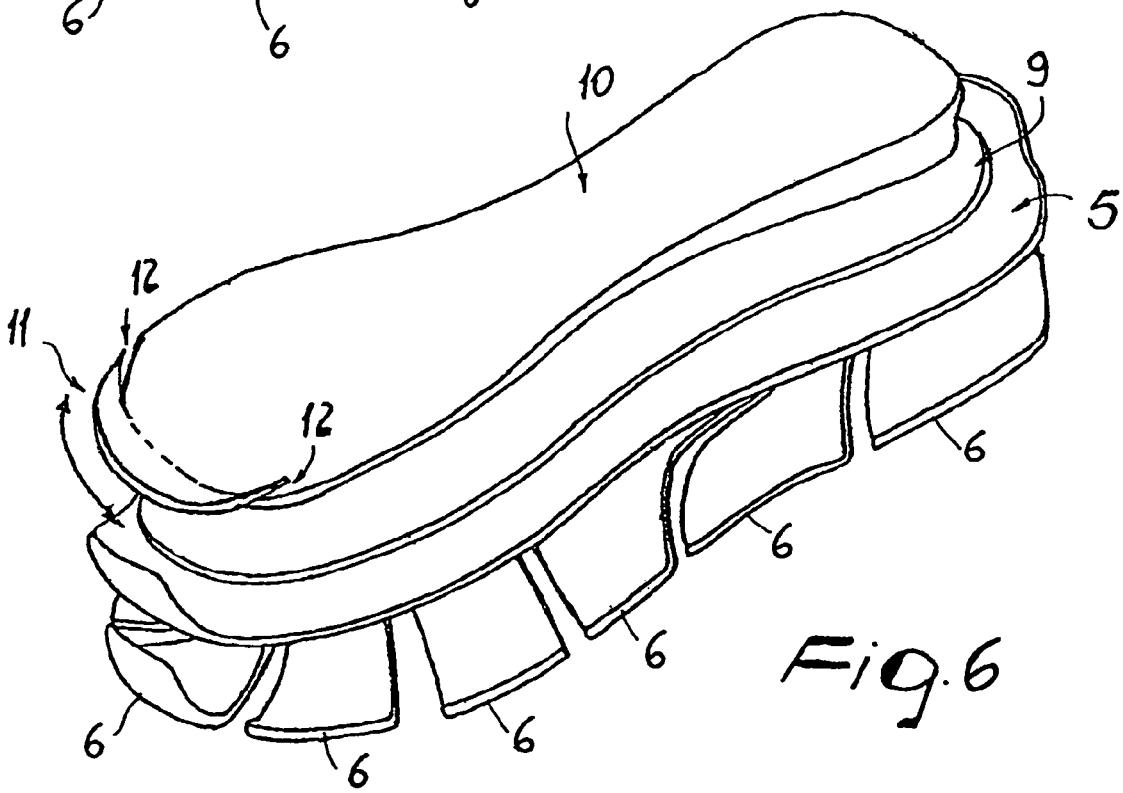
Figure 7:
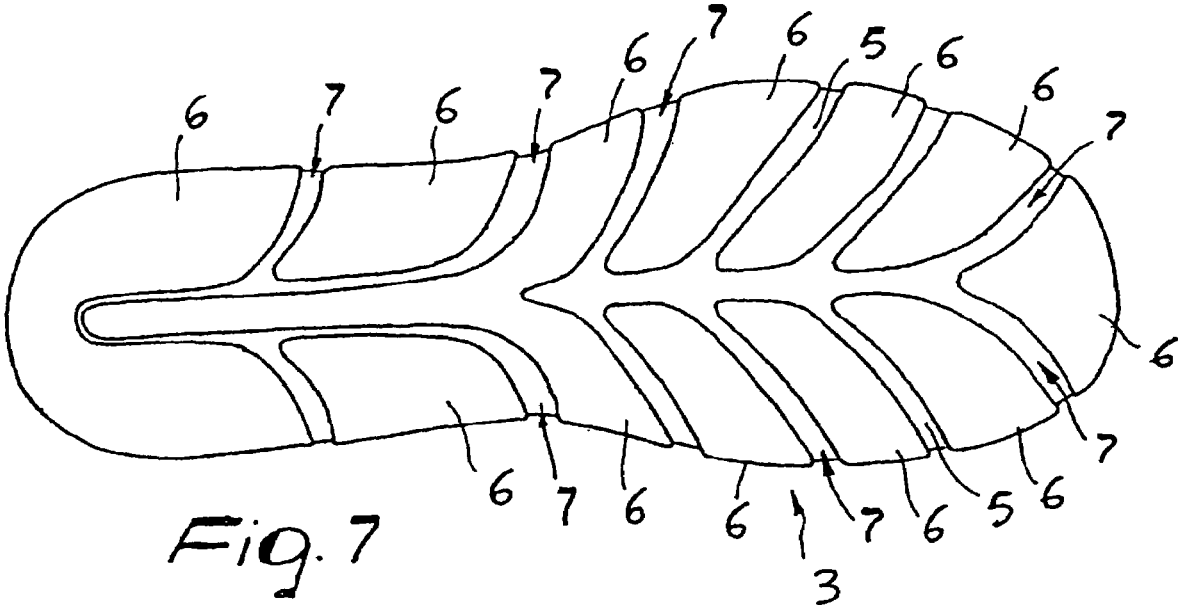
FIGS. 7–11 are schematic top views of various embodiments of the sole of the footwear structure, according to the present invention.
Figure 8:
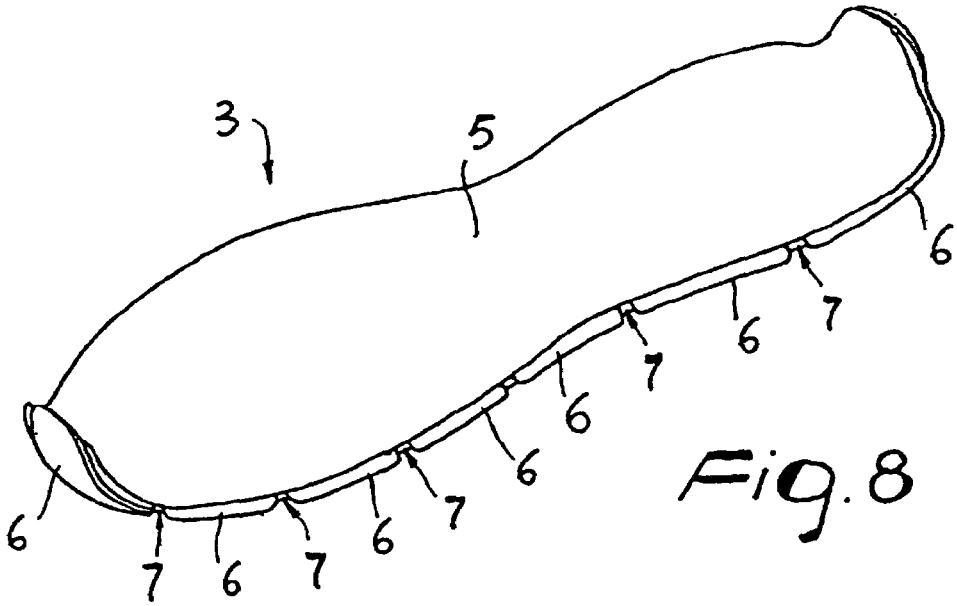

The fitting means may advantageously comprise also third regions 30 of the sole 3, which are at least partially made of a resiliently deformable material. The third regions 30 may comprise, for example, a first layer 5, fabricated in waterproof resiliently deformable material, preferably presenting a high resistance to perforation and abrasion. For example, it is possible to use materials such as rubber or a resiliently deformable fabric provided with a weft that is combined with threads in materials presenting high strength, such as the material known by the brand name "KEVLAR®". The bottom of the first layer 5 is preferably associated to one or more separate layers in contact with the ground, which advantageously comprise a plurality of inserts 6 possibly fabricated in a rigid or semi-rigid plastic material. In this manner, the inserts 6, being in contact with the ground, present advantageously characteristics of high resistance to perforation and a high resistance to abrasion. The arrangement of the inserts 6 on the first layer 5 may be the most suitable in relation to the characteristics of deformability required by the sole 3. Particularly, such inserts 6 may be arranged according to a layout defining a plurality of grooves 7, which allows an easy deformation of the sole 3. The inserts 6 may be associated with the first layer 5 through stitching with rubber thread or with traditional non-elastic thread. In this second case, to maintain the resilient characteristics of the sole 3, the arrangement of the inserts 6 on the first layer 5 allow excellent deformability of the sole 3 both in a transverse and especially in a longitudinal direction (see FIG. 4). The inserts 6 may also be glued to the first layer 5, or over-injected, or also made one with the same, for example through a single injection moulding operation of plastic material.

The sole 3 comprises advantageously also a pliable region 15, which is obtained approximately transversely near the toe portion 110 of the footwear structure 1. In its more general definition, the footwear structure according to the present invention is therefore characterised in that the sole 3 has a pliable region 15 in proximity of its toe end, said pliable region 15 allowing a bending of the toe portion of the upper with a consequent change of its overall longitudinal dimension so as to accommodate the internal volume of the footwear structure to the size of a user's foot.

It should be appreciated the different co-operating resilient deformation actions operated by the fitting means on the upper 2 and the sole 3.

The first regions 20 of the fitting means exert a resilient stress on the toe portion 110 on a predefined direction aimed at lifting up the toe portion 110 from the ground (see arrow 200). The third regions 30 (particularly in the pliable region 15) allow an easy bending of the sole 3, approximately in the same predefined direction 200, on which the resilient stress is exerted by the first regions 20.

Thus, the co-operating shrinking of at least a part of the first regions 20 and the extension of at least a part of the third regions 30 allows reducing the overall longitudinal dimension of the footwear structure 1, the size of the upper 2 being resiliently reduced. A comfortable use of the footwear structure 1 by users with small foot size is thereby allowed. Conversely, also users with larger foot size may wear the same footwear structure 1 as well. In this case, the forces exerted by the user's foot are largely higher than the resilient stress exerted by the first regions 20. The size of the upper 2 and the sole 3 is resiliently enhanced and the toe portion 110 is thereby forced to bend towards the ground (see arrow 201). Therefore, the overall longitudinal dimension of the footwear structure 1 is enhanced.

The interconnection between the upper 2 and the sole 3 may be suitably accomplished through the bending and fixing of the side edges 80 and 81 of the upper 2, along the upper surface of the sole 3. Such kind of interconnection allows to maintain substantially unchanged the resilient characteristics of the footwear structure 1 and may therefore be accomplished, for example, by stitching, using a thread made in elastic material, or through gluing of the side edges 80 and 81 on top of the first layer 5, or with a combination of the two techniques. It is advisable that the parts are glued together using non-crystallising glue, since such process of crystallisation may lead to a reduction, sometimes considerable, in the characteristics of resilience of the materials in contact.

Figure 12:
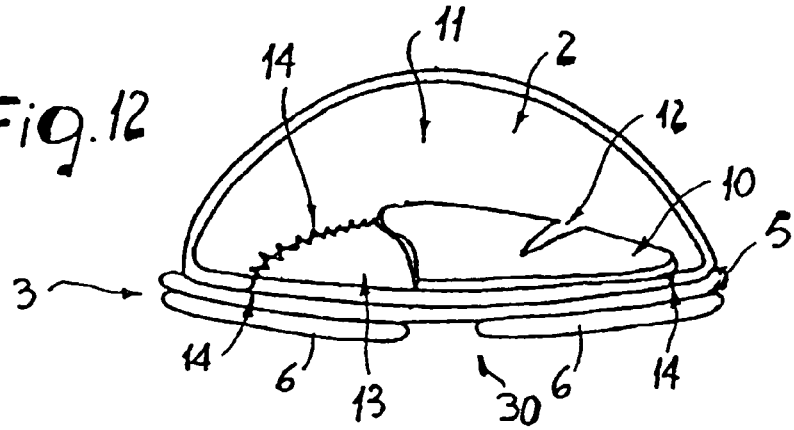
FIG. 12 is a cross section view of another preferred embodiment of the footwear structure, according to the present invention.

Preferably, as shown in FIG. 12, the footwear structure may comprise third fitting means, said third fitting means comprising a separate layer of resiliently deformable fabric 13, which is inserted between the upper 2 and the sole 3. The layer 13 may be advantageously fabricated in the same material as the first regions 20 of the upper 2. Such separate layer 13 is attached to the outer edges 14 of the upper 2, preferably by means of a known type of stitching, known by the name of "Strobel stitching", in such a way as to fabricate a substantially tubular shaped upper. It should be noticed that the use of the layer 13 allows to achieve (in co-operation with the resilient action exerted by the first regions 20) a comfortable lateral fit of the upper to the user's foot, even if the size/shape of the user's foot varies remarkably.

Figure 9:
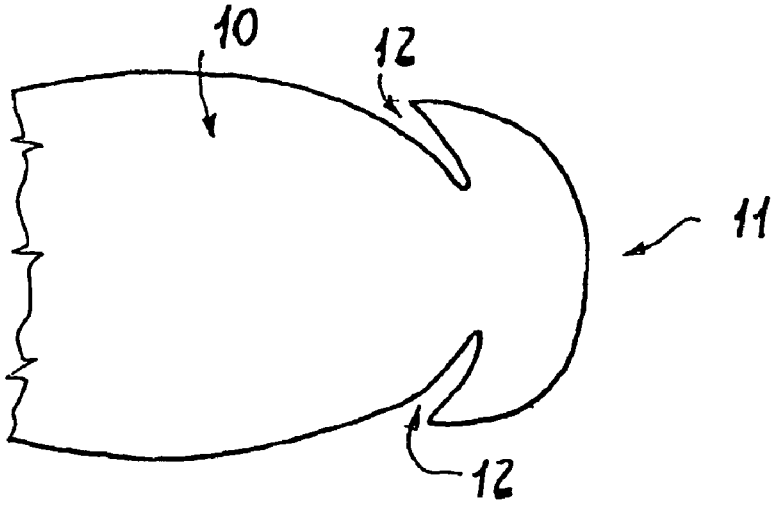
Figure 10:
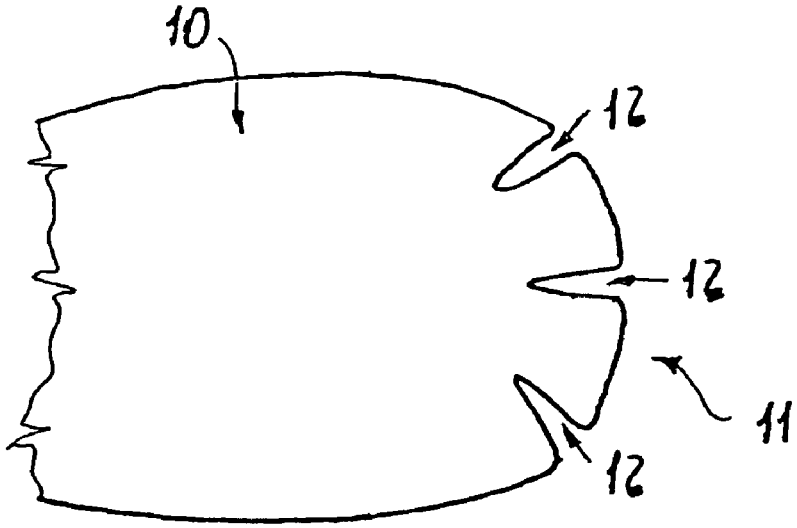
Figure 11:
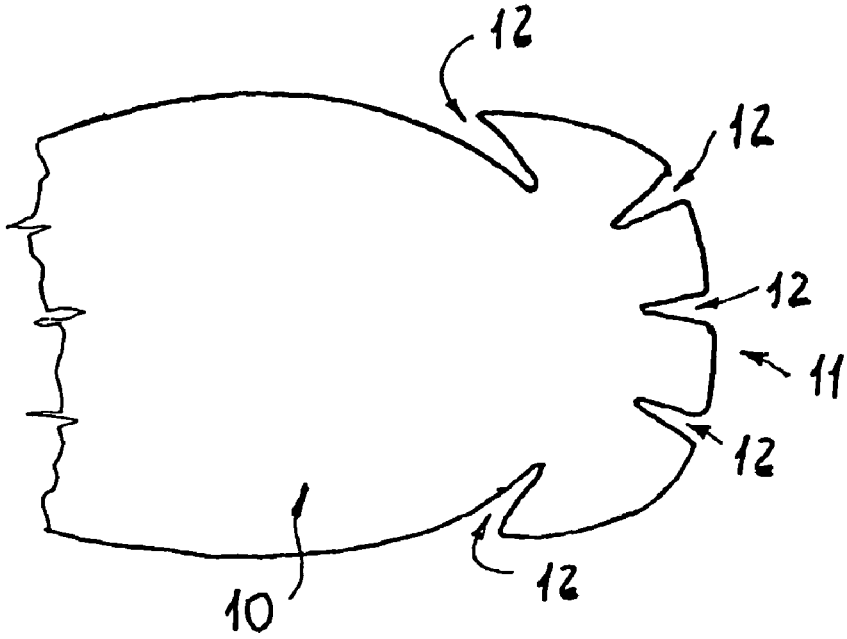

Inside the upper 2 and at its bottom part, on the upper surface of the sole 3, a first mounting insole 9 may be advantageously positioned, so as to ensure a certain rigidity of the sole 3 or arch support of the footwear structure 1. This first insole 9 may, for example, comprise a suitably shaped sheet of rubber. A second insole 10 may be also arranged on top of the first insole 9, so as to increase the rigidity of the sole 3. The second insole 10 may comprise advantageously also second fitting means arranged so as to allow a variation in the longitudinal extension of the second insole 10. Particularly, the second fitting means are positioned at the front of the second insole, in correspondence of a portion 11 of the toes and may comprise two or more notches 12, suitable for giving the second insole 10 the possibility of varying its longitudinal extension, thereby allowing free elongation of the footwear structure 1. The second insole 10 may be shaped in such a way as to present a desired number of notches, variously positioned, as illustrated in FIG. 9–11. Additionally, the second insole 10 may also have a suitable profile, in which a block or a gentle protuberance (not shown) in the foot arch region are accentuated, thereby making it more comfortable for the user.

Figure 3:
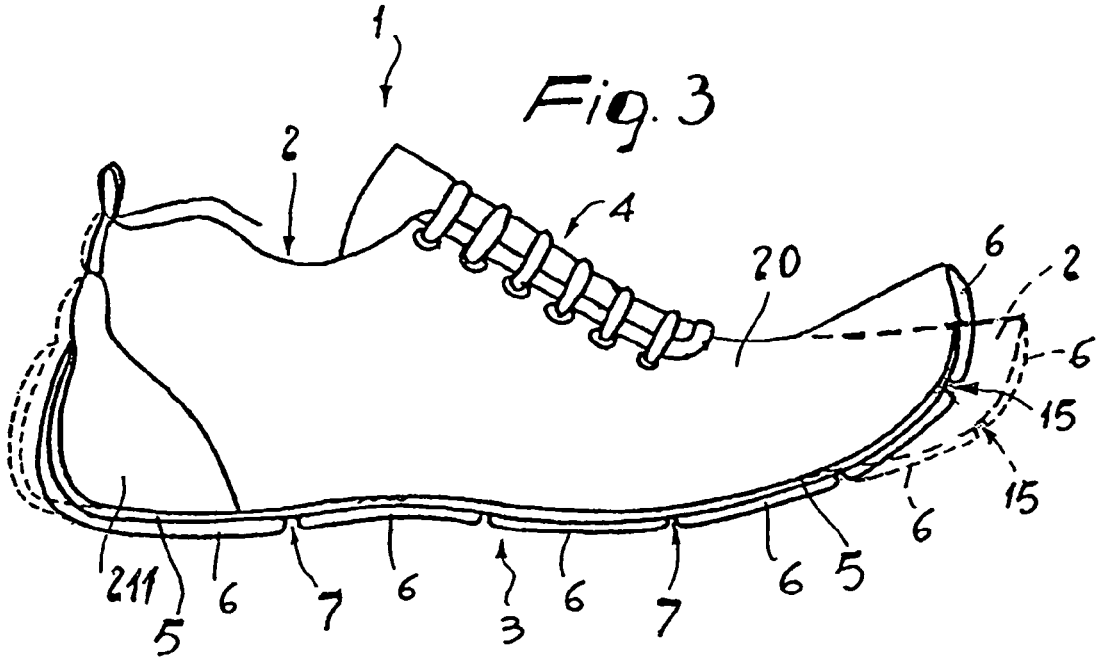
FIGS. 3–4 are a different views of a preferred embodiment of the footwear structure, according to the present invention, worn by feet of different sizes.

Use of the footwear structure 1, according to the present invention, is therefore as follows: with reference to FIGS. 1 and 3, the force exerted by the first fitting means induce the footwear structure 1 to accommodate its internal volume to the shape/size of the user's foot. The fitting means are self adjustable since they exert their action of resiliently deforming the upper 2 and the sole 3 according to the shape/size of the user's foot without the need of being operated by the user. In fact, if the footwear structure 1 is worn by a person with small feet, the first fitting means make the upper 2 clinging immediately to the foot shape and make the toe portion 110 bending upward to decrease the length of the footwear structure 1. At the same time the portion 11 of the second insole 10 comforms to the movement of the toe portion 110 and flexes upwards, bending along the notches 12. If the user has larger foot size, the first fitting means allows the upper 2 to expand according to the foot shape/size, while the toe portion 110 (togenther with the second insole 10) is allowed to bend towards the ground, thereby determining an increase of the length of the footwear structure 1.

It has thus been shown in practice that the footwear structure 1, according to the present invention, allows to achieve the intended aim and objects, since it can be used in maximum comfort by users with different shape and size feet and since it is provided, at the same time, with a very simple structure. In particular, the described structure may efficiently cover at least two successive sizes: in this way, both manufacturing costs and especially storage costs are considerably reduced. Fabrication costs are also remarkably reduced thanks to the intrinsic simplicity of the footwear structure 1. Additionally, thanks to its considerable resilient deformability, the footwear structure 1 may also be easily rolled up or bent, so that it can be much easily transported or stored.

The invention claimed is:

1. A footwear structure comprising:

an upper (2) comprising a toe portion (110) and a heel portion (120), and a sole (3) associated to the upper (2), wherein the sole and the upper comprise first fitting means for accommodating the internal volume of the footwear structure to the size of a user's foot by means of co-operating resilient deformation of the upper and the sole, the first fitting means comprising:

a first region (20) of the upper, which is at least partially made of resiliently deformable material and exerts a resilient stress on the toe portion (110) of the upper along a vertical direction to lift up the toe portion of the upper from the ground; and a third region (30) of the sole, which is at least partially made of resiliently deformable material and allows an easy bending of the sole so as to allow the lift up of the toe portion of the upper from the ground, the third region comprising at least a first layer (5) made of waterproof resiliently deformable material having a relatively high resistance to perforation and abrasion, one or more inserts (6), which are in contact with the ground and which are made of rigid or semi-rigid plastic materials with a relatively high resistance to perforation and abrasion, being arranged at the bottom of the first layer (5), so as to define a plurality of grooves (7), wherein the plurality of grooves forms a first continuous grid and a second continuous grid respectively at portions of the sole that correspond to the toe portion and the heel portion of the upper, so as to allow an easy deformation of the sole in a transverse direction and longitudinal direction, wherein each of the first continuous grid and the second continuous grid comprises one or more longitudinal grooves crossed by a plurality of transversal grooves, the longitudinal grooves and the transversal grooves being interconnected to form each of the first and second continuous grids.

2. A footwear structure according to claim 1, wherein said first fitting means are arranged so as to allow a longitudinal and a transversal resilient deformation of said upper and said sole.

3. A footwear structure according to claim 1, wherein said first fitting means comprise a second region (21) of the upper, which is at least partially made of materials presenting a reduced tension set.

4. A footwear structure according to claim 1, wherein said third region comprises a pliable region (15), which allows a bending of said toe portion (110) of said upper.

5. A footwear structure according to claim 1, wherein said footwear structure comprises a first insole (9), which is arranged inside and at the bottom part of said upper (2).

6. A footwear structure according to claim 5, wherein said footwear structure comprises a second insole (10), which is arranged inside said upper (2) approximately at the upper surface of said first insole (9).

7. A footwear structure according to claim 6, wherein said second insole comprises second fitting means arranged so as to allow a variation in the longitudinal extension of said second insole.

8. A footwear structure according to claim 7, wherein said second fitting means comprises two or more notches (12) arranged at a toe portion (11) of said second insole.

9. A footwear structure according to claim 1, wherein the side edges of said upper (2) are bent and fixed at the upper surface of said sole (3).

10. A footwear structure according to claim 1, comprising a third fitting means having a separate layer of resilient deformable fabric (13) which is inserted between the upper (2) and the sole (3).

* * * * *